US008944970B2

(12) United States Patent
Raumann et al.

(10) Patent No.: US 8,944,970 B2
(45) Date of Patent: Feb. 3, 2015

(54) APPARATUS FOR AEROBIC EXERCISE

(76) Inventors: Kelvin A. Raumann, Henderson, NV (US); Wanda L. Raumann, Las Vegas, NV (US)

( * ) Notice: Subject to any disclaimer, the term of this patent is extended or adjusted under 35 U.S.C. 154(b) by 144 days.

(21) Appl. No.: 13/439,741

(22) Filed: Apr. 4, 2012

(65) Prior Publication Data

US 2013/0267389 A1 Oct. 10, 2013

(51) Int. Cl.

| | |
|---|---|
| ***A63B 21/00*** | (2006.01) |
| ***A63B 22/00*** | (2006.01) |
| ***A63B 71/00*** | (2006.01) |

(52) U.S. Cl.
USPC ..... 482/92; 482/51; 482/70

(58) Field of Classification Search
USPC ..... 482/51, 70, 71, 79, 80, 92
See application file for complete search history.

(56) References Cited

U.S. PATENT DOCUMENTS

| | | | | | |
|---|---|---|---|---|---|
| 2,720,396 | A | * | 10/1955 | Pfaus | 482/130 |
| 3,559,986 | A | * | 2/1971 | Ehrmantraut | 482/70 |
| 3,807,727 | A | * | 4/1974 | Ferguson | 482/71 |
| 4,402,506 | A | * | 9/1983 | Jones | 482/70 |
| 4,618,139 | A | * | 10/1986 | Haaheim | 482/70 |
| 4,743,015 | A | * | 5/1988 | Marshall | 482/70 |
| 4,781,372 | A | * | 11/1988 | McCormack | 482/70 |
| 5,279,530 | A | * | 1/1994 | Hess | 482/70 |
| 5,279,531 | A | * | 1/1994 | Jen-Huey | 482/70 |
| 5,304,106 | A | * | 4/1994 | Gresko | 482/53 |
| 5,499,955 | A | * | 3/1996 | Becker et al. | 482/51 |
| 5,499,958 | A | * | 3/1996 | Hess | 482/79 |
| 5,855,538 | A | * | 1/1999 | Argabright | 482/70 |
| 6,830,539 | B2 | * | 12/2004 | Chuang | 482/53 |
| 6,837,838 | B2 | * | 1/2005 | List | 482/147 |
| 7,922,626 | B2 | * | 4/2011 | Larson | 482/54 |
| 7,931,568 | B1 | * | 4/2011 | Lin | 482/70 |
| 7,951,050 | B2 | * | 5/2011 | Raumann et al. | 482/79 |
| 2006/0046902 | A1 | * | 3/2006 | Chang | 482/52 |
| 2009/0098983 | A1 | * | 4/2009 | Hoffman | 482/70 |

* cited by examiner

*Primary Examiner* — Stephen Crow
*Assistant Examiner* — Garrett Atkinson
(74) *Attorney, Agent, or Firm* — Ariel S. Bentolila; Bay Area IP Group LLC

(57) ABSTRACT

An apparatus comprises a first unit having a frame comprising a top and bottom arm and a first pivot point. A track comprises two rods disposed between the arms. A pad unit is configured to be slidably joined to the first track. The pad unit comprises a base portion having two grooves for joining to the rods, and a top portion to contact for moving the pad unit. A second unit has a frame comprising a top and bottom arm and a second pivot point. The second pivot point is configured for pivotal joining to the first pivot point. A second track comprises two rods disposed between the arms. A pad unit is configured to be slidably joined to the second track. The pad unit comprises a base portion having two grooves for joining to the rods, and a top portion to contact for moving the pad unit.

8 Claims, 6 Drawing Sheets

APPARATUS FOR AEROBIC EXERCISE

CROSS-REFERENCE TO RELATED APPLICATIONS

The present continuation patent application claims priority benefit the U.S. nonprovisional patents Ser. No. 12/497,648 filed on 4 Jul. 2009 and titled "An Apparatus for Aerobic Leg Exercise of a Seated User" and Ser. No. 13/079,762 filed on 4 Apr. 2011 and titled "An Apparatus for Aerobic Leg Exercise of a Seated User", which is hereby incorporated by reference for all purposes to the extent that such subject matter is not inconsistent herewith or limiting hereof.

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office, patent file or records, but otherwise reserves all copyright rights whatsoever.

FIELD OF THE INVENTION

One or more embodiments of the invention generally relate to exercise equipment. More particularly, one or more embodiments of the invention relate to an exercise device for placement on the floor that can be easily operated by a seated user.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon. It is believed that many Americans spend a great deal of time sitting at a desk, which may result in becoming out of shape. It is also believed that many Americans want to exercise, yet many lack the opportunity. Typically these individuals lack the time to regularly go to a gym or otherwise exercise because of their jobs. Often, the exercising of the lower half of the body, in particular the legs, with regularity may result in maintaining weight and a desired physical appearance as well as addressing established medical needs.

By way of educational background, an aspect of the prior art generally useful to be aware of is that unique and innovative health and personal care items and related products have been an interest and potential need of wide segments of individuals including, but not limited to, users, manufacturers, suppliers, and retailers. Included among these individuals are the sporting and athletic goods industry and private individuals.

In view of the foregoing, it is clear that these traditional techniques are not perfect and leave room for more optimal approaches.

BRIEF DESCRIPTION OF THE DRAWINGS

The present invention is illustrated by way of example, and not by way of limitation, in the figures of the accompanying drawings and in which like reference numerals refer to similar elements and in which:

FIG. 1A is a diagrammatic top view. FIG. 1B is a diagrammatic top view of the exercise device in a disassembled state. FIG. 1C is a top and bottom diagrammatic view of padded units of the exercise device, and FIG. 1D is a diagrammatic side view of the exercise device in use;

FIG. 4A is a diagrammatic top view of the exercise device in a closed position. FIG. 4B is a diagrammatic top view of the exercise device in an open position. FIG. 4C is a diagrammatic bottom view of a foot pad from the exercise device. FIG. 4D is a side perspective view of the foot pad being installed on the exercise device, and FIG. 4E is a side perspective view of the foot pad installed on the exercise device.

Figure 1A:
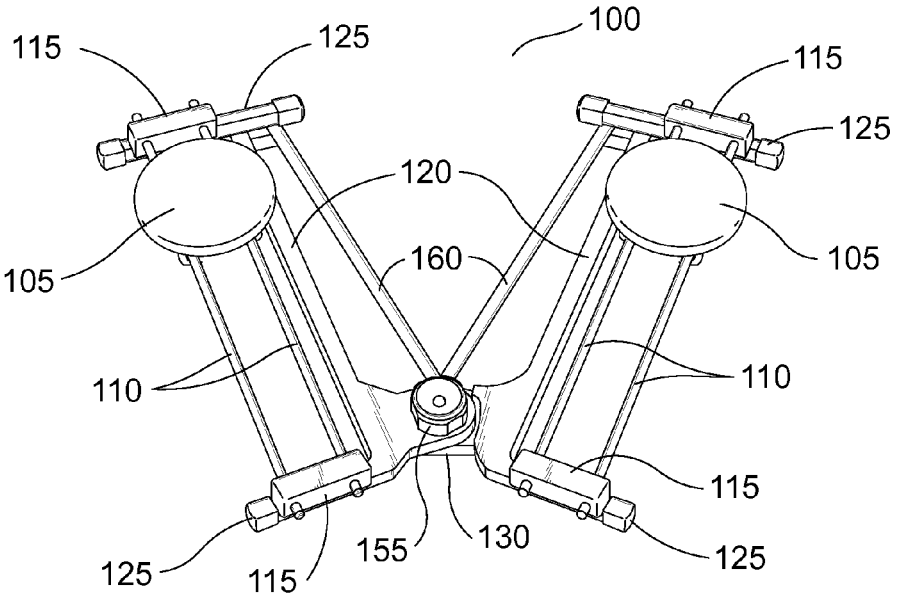
FIGS. 1A, 1B, 1C, and 1D illustrate an exemplary exercise device, in accordance with an embodiment of the present invention.

Unless otherwise indicated illustrations in the figures are not necessarily drawn to scale.

DETAILED DESCRIPTION OF THE PREFERRED EMBODIMENTS

Embodiments of the present invention are best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are numerous modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

It is to be further understood that the present invention is not limited to the particular methodology, compounds, materials, manufacturing techniques, uses, and applications, described herein, as these may vary. It is also to be understood that the terminology used herein is used for the purpose of describing particular embodiments only, and is not intended to limit the scope of the present invention. It must be noted that as used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" is a reference to one or more steps or means and may include sub-steps and subservient means. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

Unless defined otherwise, all technical and scientific terms used herein have the same meanings as commonly understood by one of ordinary skill in the art to which this invention belongs. Preferred methods, techniques, devices, and materials are described, although any methods, techniques, devices, or materials similar or equivalent to those described herein may be used in the practice or testing of the present invention. Structures described herein are to be understood also to refer to functional equivalents of such structures. The present invention will now be described in detail with reference to embodiments thereof as illustrated in the accompanying drawings.

From reading the present disclosure, other variations and modifications will be apparent to persons skilled in the art. Such variations and modifications may involve equivalent and other features which are already known in the art, and which may be used instead of or in addition to features already described herein.

Although Claims have been formulated in this Application to particular combinations of features, it should be understood that the scope of the disclosure of the present invention also includes any novel feature or any novel combination of features disclosed herein either explicitly or implicitly or any generalization thereof, whether or not it relates to the same invention as presently claimed in any Claim and whether or not it mitigates any or all of the same technical problems as does the present invention.

Features which are described in the context of separate embodiments may also be provided in combination in a single embodiment. Conversely, various features which are, for brevity, described in the context of a single embodiment, may also be provided separately or in any suitable subcombination. The Applicants hereby give notice that new Claims may be formulated to such features and/or combinations of such features during the prosecution of the present Application or of any further Application derived therefrom.

References to "one embodiment," "an embodiment," "example embodiment," "various embodiments," etc., may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

As is well known to those skilled in the art many careful considerations and compromises typically must be made when designing for the optimal manufacture of a commercial implementation any system, and in particular, the embodiments of the present invention. A commercial implementation in accordance with the spirit and teachings of the present invention may configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

It is to be understood that any exact measurements/dimensions or particular construction materials indicated herein are solely provided as examples of suitable configurations and are not intended to be limiting in any way. Depending on the needs of the particular application, those skilled in the art will readily recognize, in light of the following teachings, a multiplicity of suitable alternative implementation details.

Preferred embodiments of the present invention provide an exercise device for placement on the floor that a user can easily operate while seated in front of it. Preferred embodiments feature padded units that can be pushed by the feet to slide upon linear tracks. In typical use of the preferred embodiment, a user simply applies his feet upon the padded units and slides the units back and forth.

The exercises for which preferred embodiments of the present invention can be used are aerobic and non-resistant, meaning the user does not have to break out in a sweat after short and simple use. Preferred embodiments are also quietly operated. The compact size of preferred embodiments enables these devices to easily fit under a work desk. These qualities enable preferred embodiments to fit within a workspace, to be used within this workspace, and to not put users in any condition that would make them sweaty or in any other way unfit for their workspace. Preferred embodiments also enable therapeutic physical exercises to be done in a format that is convenient to those of recognized need for such exercise and convenience. Furthermore, preferred embodiments require no lubrication or other maintenance services.

Figure 1B:
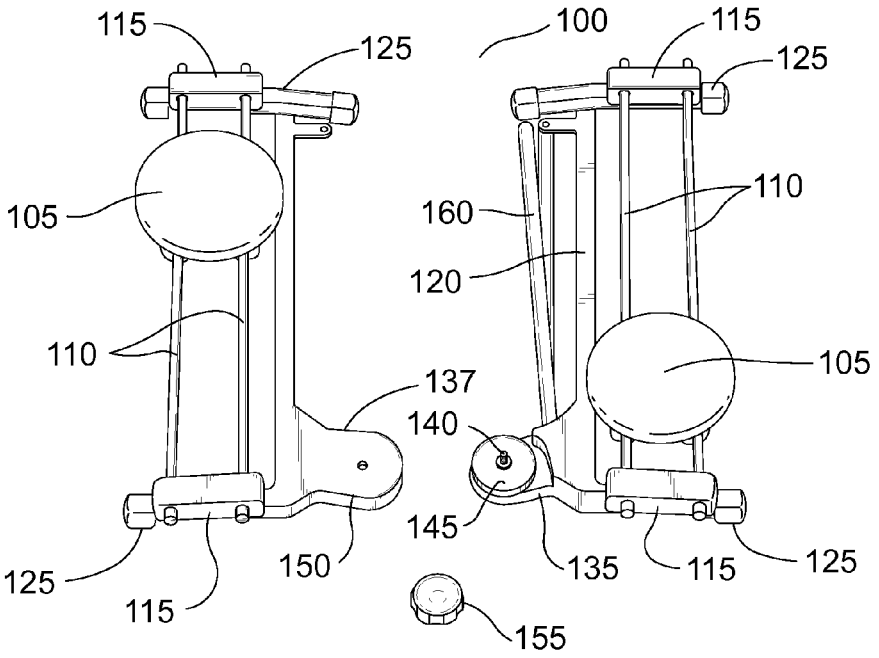
Figure 1C:
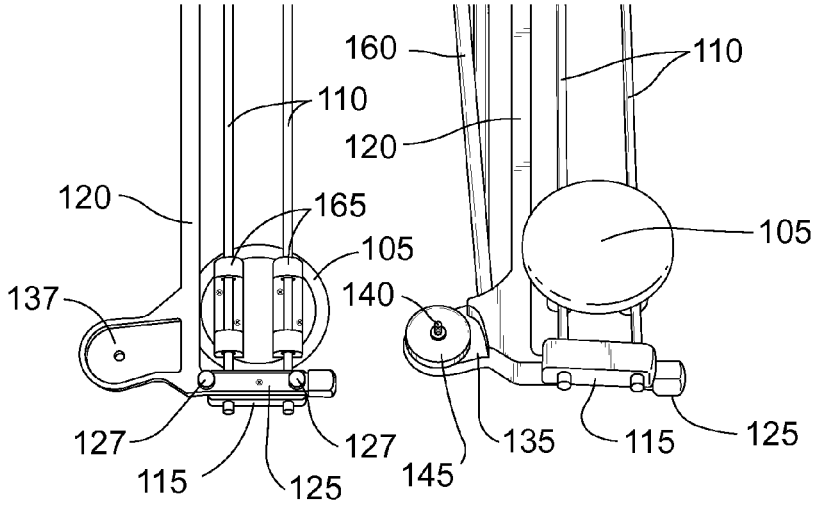
Figure 1D:
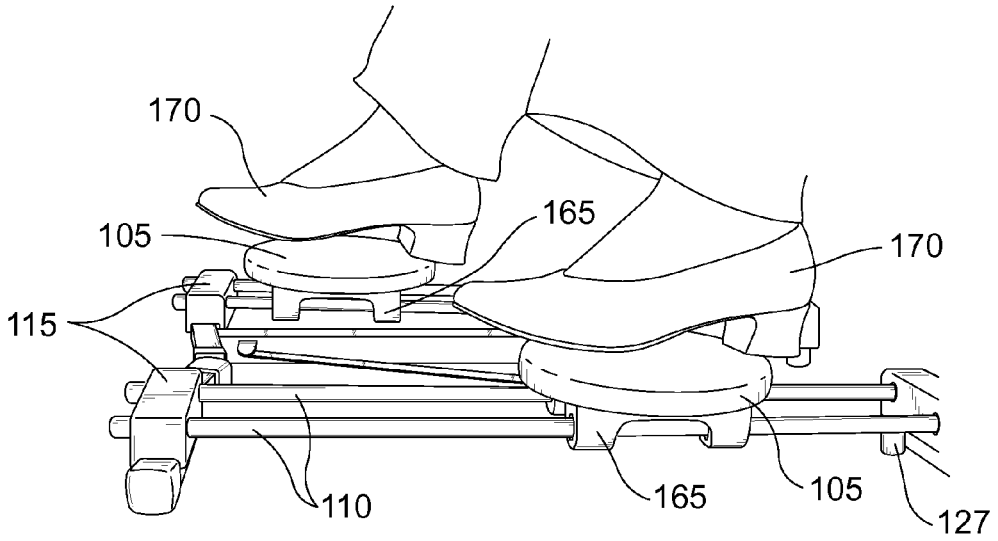

FIGS. 1A, 1B, 1C, and 1D illustrate an exemplary exercise device 100, in accordance with an embodiment of the present invention. FIG. 1A is a diagrammatic top view. FIG. 1B is a diagrammatic top view of exercise device 100 in a disassembled state. FIG. 1C is a top and bottom diagrammatic view of padded units 105 of exercise device 100, and FIG. 1D is a diagrammatic side view of exercise device 100 in use. In the present embodiment, exercise device 100 provides means for aerobic and repetitive motion exercises of the lower limbs to be conducted while sitting. Exercise device 100 comprises padded units 105 that slide upon linear tracks 110 and can be positioned upon a floor in any location. Exercise device 100 comprises two separate units of linear tracks 110. Linear tracks 110 are preferably made of durable high-density polyethylene (HDPE) tubing that is approximately twenty-four inches in length and one half-inch diameter (24"×½"). These units of tubing are in parallel alignment to each other with an approximate five-inch (5") separating distance. Those skilled in the art, in light of the present teachings will readily recognize that the liner tracks in alternate embodiments may be made of various different materials such as, but not limited to, various metals or other types of plastic and may be various different sizes and widths. In the present embodiment, the ends of the aligned tubing units of linear tracks 110 are enclosed within brackets 115 which are preferably made of HDPE; however the brackets in alternate embodiments may be made of various different materials such as, but not limited to, other types of plastic, rubber, metal, wood, etc. In the present embodiment, each linear track 110 is mounted upon an I-bar frame 120 with end brackets 115 being mounted upon extending arms 125 of frame 120. Frame 120 is preferably made of high-density polyethylene (HDPE) approximately one and one-quarter inch (1¼") in diameter. The total size of the two (2) linear track-hosting frames 120 is approximately twenty-four inches in length by eleven inches in width (24"× 11"). Those skilled in the art, in light of the present teachings, will readily recognize that the frames in alternate embodiments may be made of various different materials such as, but not limited to, metal or other types of plastic and may be various different sizes. Linear tracks 110 can be positioned parallel to each other or at various different angles. In the present embodiment, I-bar frames 120 comprise a hinge point 130 that serves as a fulcrum which separates and sets the angle of linear tracks 110. Two rubber feet 127 are attached below each outward-extending arm 125 of I-bar frames 120, totaling eight rubber feet, each of which measures approximately a half-inch in height by a half-inch in diameter (½"× ½"). Alternate embodiments may be incorporated with feet made of different materials, more or fewer feet, feet of various different sizes, or feet in various different locations. Yet other alternate embodiments may be incorporated with no feet.

Referring to FIG. 1B, extending from single corners from each I-bar frame 120, and in corresponding alignment to each other, are roundhead arms 135 and 137 of five and three-quarters of an inch length by three and one-half inch width (5¾"×3½"). In alternate embodiments these arms may be various different shapes and sizes. Extending roundhead arm 135 features a centered bolt 140 projecting upward, surrounded by an extended washer 145. Extending roundhead arm 137 features a centered aperture 150, through which bolt 140 of roundhead arm 135 may be inserted to create hinge point 130. A threaded attachment cap 155 is included for attachment upon bolt 140. The configuration of hinge point 130 enables a user to remove attachment cap 155 to separate I-bar frames 120 from each other. Being able to be separated into two pieces enables exercise device 100 to be easily moved and may save money on packaging and shipping. Furthermore, exercise device 100 may come with a carrying case for transporting exercise device 100 from location to location. This enables a user to own one exercise device 100 and use it in multiple locations for example, without limitation, at both home and at work. Those skilled in the art, in light of the present teachings, will readily recognize that the hinge point in alternate embodiments may comprise various types of hinging means such as, but not limited to, a barrel hinge, an arched slot in which rods on the I-bar frames may slide, a simple male/female hook device that connects the two I-bar frames together, a rubberized flexible band, a magnetic attachment, or no hinge point and the user can set the two I-bars in close proximity to one another, etc. In the present embodiment, rubber caps encase each of the three remaining endpoints on each I-bar frame 120; however, in alternate embodiments these caps may be omitted or made of various different materials such as, but not limited to, various types of plastic. In the present embodiment a two-piece stabilizer bar 160 attaches to I-bar frames 120. Each portion of stabilizer bar 160 measures approximately twenty-one inches in length by half-inch diameter (21"×½"); however, the stabilizer bar in alternate embodiments may be larger or smaller. Some alternate embodiments may be incorporated without a stabilizer bar. In the present embodiment, stabilizer bar 160 attaches at points on I-bar frames 120 opposite of extending roundhead arms 135 and 137 and enables I-bar frames 120 to open in an arc pattern while remaining joined at attached extending roundhead arms 135 and 137.

Referring to FIGS. 1C and 1D, padded units 105, made of polyurethane (PU) foam and sealed within a vinyl material, fit on and move upon linear tracks 110 to enable a user to conduct aerobic exercise of the lower extremities. In the present embodiment, padded units 105 are round and of an approximate seven-inch (7") diameter. The center-point depth of padded units 105 is approximately one and one-half inches (1½"), which tapers to a half-inch (½") depth at their perimeters. The rounded design of padded units 105 enables users to maintain good foot contact with padded units 105 regardless of the angle of positioning. For example, without limitation, if exercise device 100 is spread into a wide angle or if it is not spread out at all the feet can still maintain good contact with padded units 105. However, in alternate embodiments, the padded units may be made in various sizes and shapes and may be made of various different materials such as, but not limited to, various plastics, wood, etc. In some embodiments the padded units may comprise straps to hold the feet on the padded units. In some embodiments the padded units may include toe caps that protrude slightly above and slightly over the surface of the padded unit so the user can insert their toes under it to help secure their foot in place. In some embodiments the padded units may include a toe cap and a strap to help maintain the foot in place. In another embodiment this strap and toe cap may rotate around the padded unit in order to maintain foot placement as the splay of the two I-bars change. In the present embodiment, padded units 105 attach upon linear tracks 110 with rotary plane bearing bushings 165 that measure approximately one-inch in length by three-quarters of one inch in width (1"×¾"). Bushings 165 are placed with an approximate three and one-half inch (1½") interior distance between their mountings on the underside of padded units 105. Bushings in alternate embodiments may be larger or smaller and may be positioned on the padded units in various different locations and configurations. Furthermore, in other alternate embodiments, the padded units may be attached to the linear tracks using various different means such as, but not limited to, roller or ball bearings, solid tunnels on the bottom of the padded units, a grooves and channel system could be utilized allowing the padded units to be easily removed and re-applied, a snap on configuration where the padded units snap in place in a semi-permanent configuration, etc.

In typical use of the present embodiment, a user brings exercise device 100 to a location of choice and attaches the separate I-bar frames 120 together at corresponding roundhead arms 135 and 137. Exercise device 100 is easy to assemble and requires only two screws. The user may then attach stabilizer bar 160 to I-bar frames 120 and adjust linear tracks 110 to the angle needed to form the foot movement pattern of choice. Once linear tracks 110 are in the desired splay angle, the user tightens attachment cap 155 to hold linear tracks 110 in this position. Referring to FIG. 1D, the user may then sit in any chair and apply his or her feet 170 upon padded units 105. The user then slides feet 170 on padded units 105 back and forth on linear tracks 110 in a pattern of choice indicated by the separating arch between I-bar frames 120. Exercise device 100 enables such aerobic exercise to be conducted in practically any location.

Exercise device 100 provides a convenient means to conduct exercise while in a sitting position, and enables practical exercises to be done by persons who may ordinarily lack opportunity to perform such exercises. Unlike other devices with purposes of allowing exercise while in a sitting position, exercise device 100 does not require any elevation or separation of the knees, thus extending the areas of use of exercise device 100 in comparison to the other devices. Exercise device 100 can be applied upon any floor surface, even upon unlevel surfaces. Since exercise device 100 can easily fit in numerous locations, including, but not limited to, upon the floor area under a desk, in front of a couch, on the floor in front of a passenger seat of a vehicle, in front of wheelchairs, lounge chairs, beside beds, sports benches such as in dugouts, physical therapy benches and chairs, kitchen tables, craft tables, hobby tables, card tables, patio tables, anywhere there is enough room to situate at least one of the I-bars units, etc. This enables busy office workers to conduct practical and therapeutic exercises while working. Exercise device 100 enables persons normally restricted to docile schedules and duties to actively engage in lower extremity exercises which they would ordinarily be unable to perform due to such schedules and duties. Unlike other devices with purposes of allowing exercise while in a sitting position, exercise device 100 is non-resistant, meaning that the user can conduct aerobic exercise with reduced incidences of stress and perspiration, which ordinarily would restrict the areas of use as well as affect the appearance of the user. Exercise device 100 can be used while seated in practically any type of chair and can be easily transported to any area of use. Exercise device 100 operates very quietly with no disturbance to its area of use.

Exercise device 100 also enables persons normally restricted in mobility, such as, but not limited to, users of wheelchairs, to actively engage in lower extremity exercises which they would ordinarily be unable to perform due to such mobility restriction and enables such users to do so without direct assistance from others. Some of the exercises that these users may perform with exercise device 100 include, without limitation, hip, leg, knee, ankle and foot exercises. By enabling such exercises to be performed independently by persons normally restricted in mobility, exercise device 100 also benefits the caregivers and therapists of such persons by allowing the caregivers and therapists to accommodate service to multiple patients and clients simultaneously. By encouraging persons normally restricted in mobility to more actively engage in needed exercise, exercise device 100 can improve the recovery and rehabilitation of such persons and may improve the self-confidence and self-impressions of these users.

In the present embodiment, linear tracks 110 of exercise device 100 can be positioned in vertical alignment to each other, allowing them to fit in restrained areas, such as, but not limited to, under a desk, or linear tracks 110 can be set at various angles to each other. Stabilizer bar 160 secures linear tracks 110 at particular angles. By enabling linear tracks 110 to be set at various angles, exercise device 100 can be used for improvement of particular and defined muscle groups, joints and tendons and can help users achieve individual and specific exercise goals. By helping users achieve individual and specific exercise goals, exercise device 100 is much more personalized than other exercise equipment. By enabling linear tracks 110 to be set at various angles while remaining usable to persons with mobility impairments, exercise device 100 provides exceptional means of exercise of which persons with impaired mobility would ordinarily be completely void.

Exercise device 100 provides means to perform various different types of exercises such as, but not limited to, practical exercises for improvement of the cardiopulmonary system, range of motion exercises, exercised to tone the leg muscles and lower extremities, non-strenuous exercises of the knees, hips, ankles, feet and toes, etc. Exercise device 100 also enables users to perform exercises for specific muscles without the strain, risk of injury or discomfort in these parts of the body, which may be experienced when performing other exercise methods. For example, without limitation, exercise device 100 provides aerobic exercise of the adductors without strain upon or risk of injury to the hips, aerobic exercise of the quadriceps and popliteus without strain upon or risk of injury to the knees, aerobic exercise of the soleus, flexor, anterior and lateral leg muscles without direct impact or resultant discomfort upon the thighs, calves, feet or toes, aerobic exercise of the hamstrings without stress upon or risk of injury to the knees, hips or pelvis, aerobic exercise of the plantaris and tibaelis muscles without stress upon risk of injury to the ankles, etc.

Exercise device 100 helps users burn excess calories in an easy and practical format that enables muscles to use fats for strength and endurance, thus aiding in fat reduction, weight loss and weight management. Furthermore, exercise device 100 can provide other health benefits to its users including, but not limited to, improvement of overall circulation, alleviation of the formation of blood clots, reduction of stress and anxiety in a practical and beneficial format, reduction of the inflammation of varicose veins, telangiectasias and sunburst varicosities as well as reduction of the risk of these conditions, reduction of the risk of osteoporosis, reduction of blood pressure, increase in the count of red blood cells, which will then improve the transport of oxygen throughout the bodies of the users, etc. By increasing red blood cells and improving oxygen transport, exercise device 100 promotes the immune systems of its users and can improve their speed of recovery from injuries and illnesses. By improving the speed of recovery from injuries and illnesses, exercise device 100 can also improve the recovery rate of those using the device for rehabilitation and therapy.

All components of exercise devices according to embodiments of the present invention may be made of various materials and substances of adequate durability and usability. In addition, the entire unit of the exercise device can be made in various sizes, shapes and designs. For example, without limitation, potential alternate embodiments of the present invention are illustrated by way of example in FIGS. 2 and 3 and described in the following description.

Figure 2:
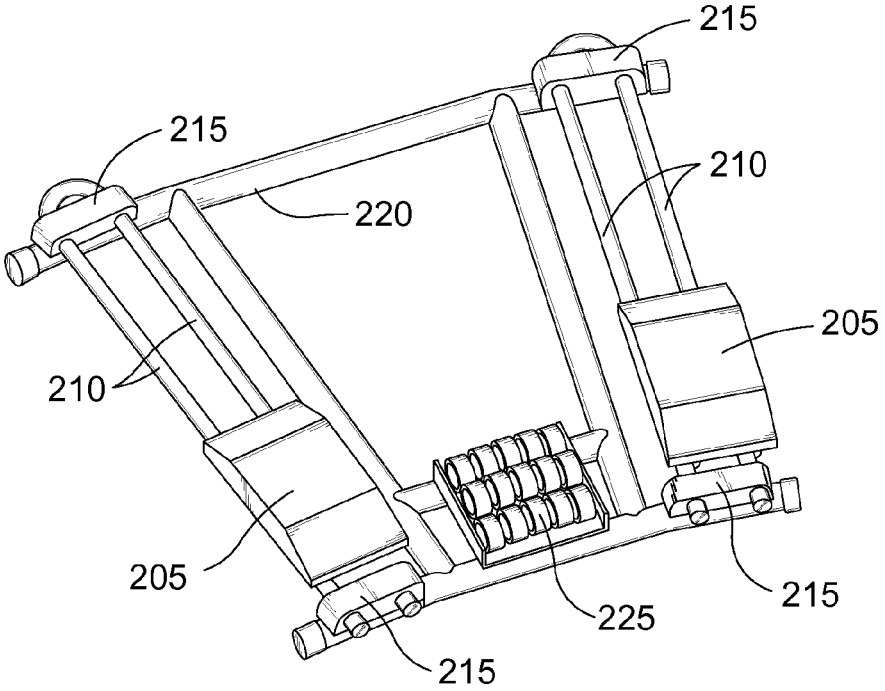
FIG. 2 is a top perspective view of an exemplary exercise device with a static frame, in accordance with an embodiment of the present invention.

FIG. 2 is a top perspective view of an exemplary exercise device 200 with a static frame 220, in accordance with an embodiment of the present invention. In the present embodiment frame 220 is preferably made of mid-gauge steel tubing of two-inch (2") diameter with an overall length of twenty four inches (24"), an overall back width of twenty seven inches (27") and an overall front width of twenty inches (20"); however, the frame may be made of various different materials and may be various different sizes. Linear tracks 210 are attached on top of frame 220 with brackets 215. The static nature of base 220 means that the angle of linear tracks 210 cannot be changed in the present embodiment. Padded units 205 are slidably attached to linear tracks 210. In the present embodiment, padded units 205 are made of foam and sealed within vinyl and measure eight inches by five inches (8"×5") with a sloping top plane. However, padded units of various different shapes, sizes and materials may be used in alternate embodiments of the present invention with a static base.

In the present embodiment, multiple free-rotating discs 225 all in vertical alignment are located on frame 220 at the center of the front of frame 220 for purpose of foot massaging and stimulation. Users can slip off their shoes after exercising to massage their feet upon discs 225. Those skilled in the art, in light of the present teaching, will readily recognize that foot massaging and stimulating means may be included on various other embodiments including, but not limited to, the embodiments illustrated and described in the foregoing an herein. For example, without limitation, free-rotating discs may be located near hinge point 130 of exercise device 100 shown, by way of example, in FIGS. 1A through 1D.

Figure 3:
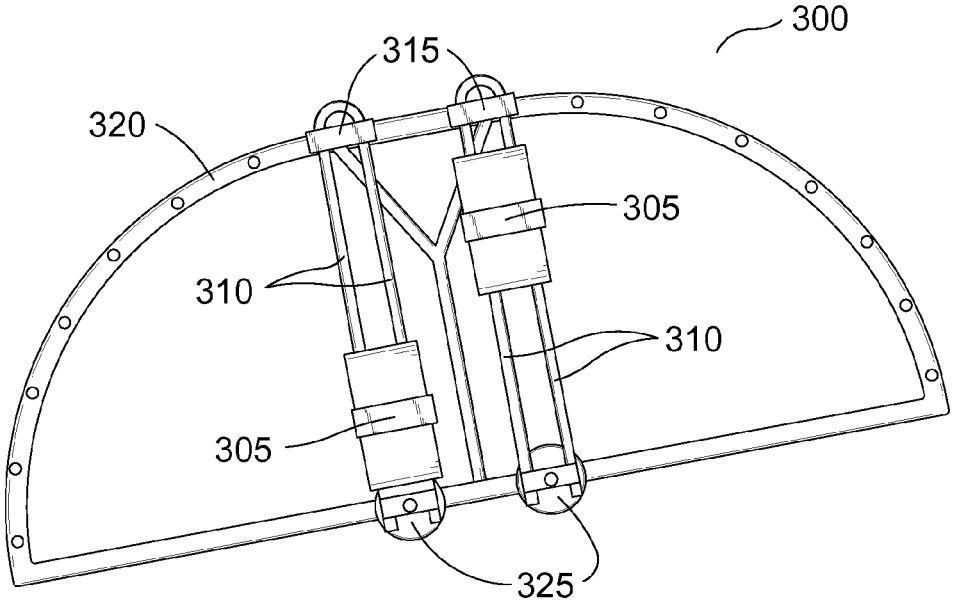
FIG. 3 is a diagrammatic top view of an exemplary exercise device with movable linear tracks, in accordance with an embodiment of the present invention.

FIG. 3 is a diagrammatic top view of an exemplary exercise device 300 with movable linear tracks 310, in accordance with an embodiment of the present invention. In the present embodiment, padded units 305 and linear tracks 310 similar to padded units 205 and linear tracks 210 shown, by way of example, in FIG. 2 are pivotally attached to an arched frame 320 at pivot points 325 and brackets 315. The user may rotate linear tracks 310 about pivot points 325 so that brackets 315 slide along the arched portions of frame 320. Various different means may be used to secure linear tracks 310 once they are in the desired position such as, but not limited to, pins on brackets 315 that are inserted into holes or divots in frame 320, pins on frame 320 that are inserted into holes or divots in brackets 315, clamps, set screws, etc.

In another alternate embodiment, the exercise device may be a motorized, continuous passive motion (CPM) device, in which a motor moves the padded units after a user's feet are securely applied upon the padded units. In this embodiment, the device may have various speed and/or resistance settings, which may be controlled by motors of various sizes. These motors may be powered by alternating current (AC) and/or direct current (DC) sources. This embodiment extends its usability to persons who recently underwent surgical procedures upon the legs, knees, ankles, feet or tendons of these areas, as well as to persons who may lack practical mobility of such limbs, joints and/or tendons.

Alternate embodiments of the present invention may include various features and accessories not described in the foregoing embodiments such as, but not limited to, the following. Some alternate embodiments may include an adjustable friction key upon the padded units to enable the user to increase the resistance and tension required to move the padded units upon their tracks. Some alternate embodiments can be made in which one end may be elevated, at a fixed height or adjustable height, to enable variations of resistance to be applied to the exercises conducted by user of the exercise device. Some alternate embodiments may include electronic accessories commonly used with other exercise devices, such as, but not limited to, a calorie meter, a pedometer, a heart rate monitor, a clock, etc. Some embodiments may include a carrying case to easily accommodate transport to, and subsequent use in, different locations. Some embodiments may bear designs, images or logos, which may or may not be of registered trademark and/or copyright status, upon any location of the device.

Figure 4A:
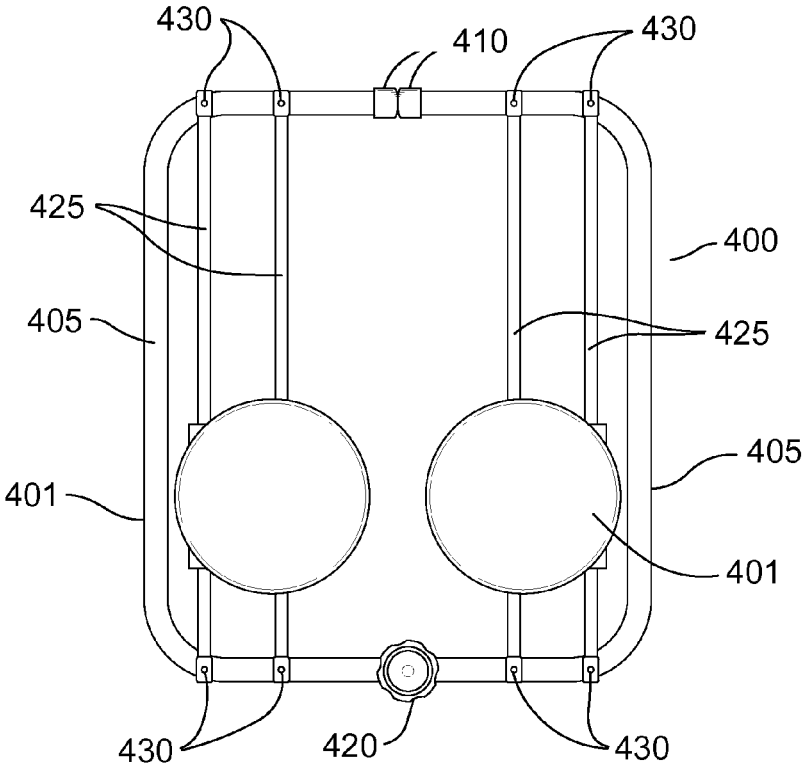
FIGS. 4A through 4E illustrate an exemplary exercise device, in accordance with an embodiment of the present invention.
Figure 4B:
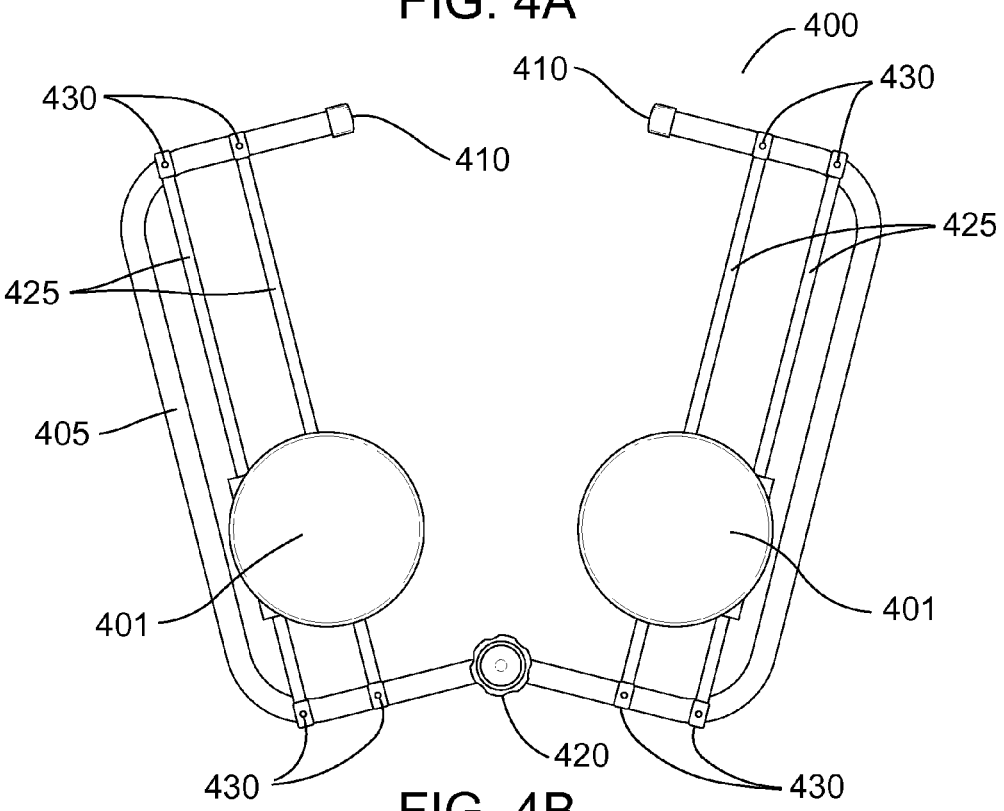
Figure 4C:
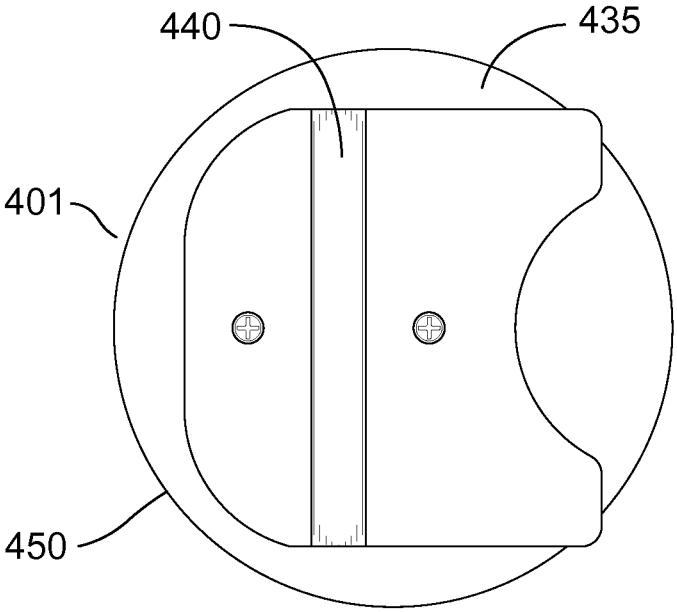
Figure 4D:
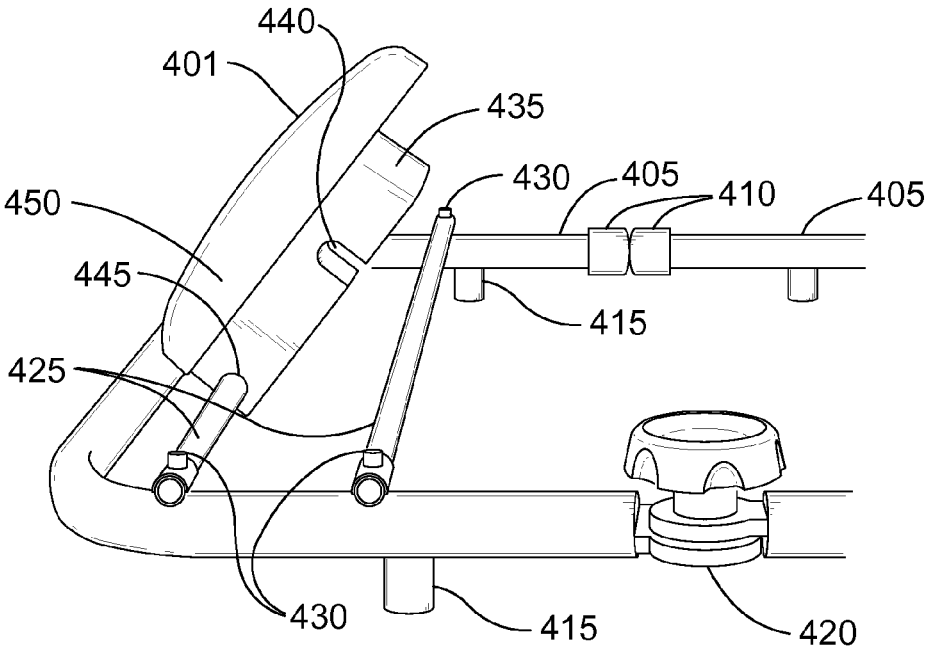
Figure 4E:
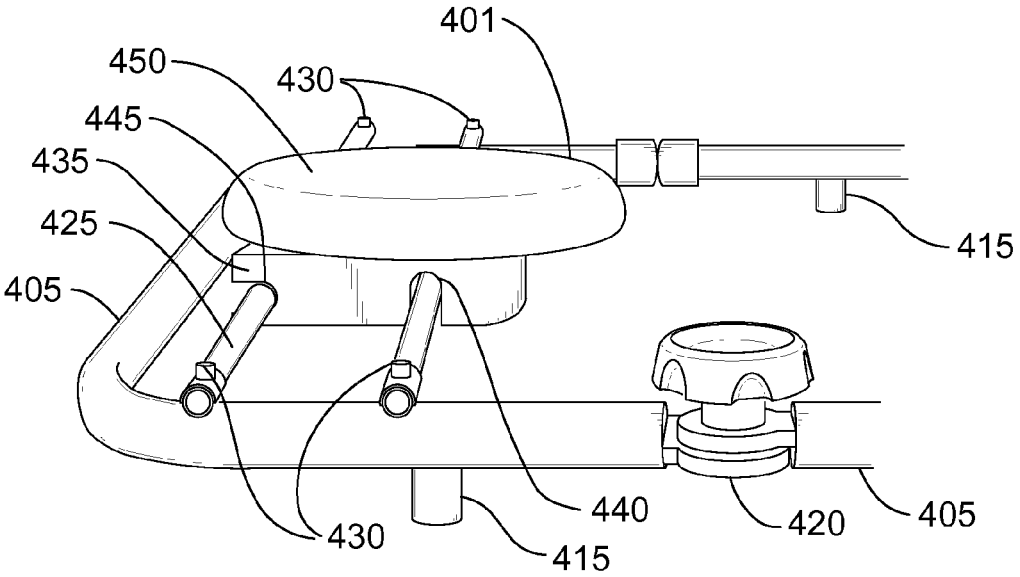

FIGS. 4A through 4E illustrate an exemplary exercise device 400, in accordance with an embodiment of the present invention. FIG. 4A is a diagrammatic top view of exercise device 400 in a closed position. FIG. 4B is a diagrammatic top view of exercise device 400 in an open position. FIG. 4C is a diagrammatic bottom view of a foot pad 401 from exercise device 400. FIG. 4D is a side perspective view of foot pad 401 being installed on exercise device 400, and FIG. 4E is a side perspective view of foot pad 401 installed on exercise device 400. In the present embodiment, exercise device 400 comprises two fame sections 405 with a rubber end cap 410 on a free end of each frame section 405 and multiple rubber feet 415 on the undersides of frame sections 405. Rubber feet 415 provide traction and stability to exercise device 400 during use. It is contemplated that some alternate embodiments may comprise different types of traction means such as, but not limited to, various different types of feet, nonslip coatings, hook and loop material, etc. Other alternate embodiments may be implemented without traction means or may be permanently attached to a surface such as, but not limited to, a floor or tabletop. Furthermore, some alternate embodiments may be implemented without end caps on the frame sections. In the present embodiment, frame sections 405 are connected at a pivot point 420 with a screw or bolt. Those skilled in the art will readily recognize, in light of and in accordance with the teachings of the present invention, that the frame sections in some alternate embodiments may be connected using a multiplicity of suitable means such as, but not limited to, hinges, and other alternate embodiments may comprise two separate sections that are not connected. Yet other alternate embodiments may be implemented on a single frame. In the present embodiment, each frame section 405 comprises two parallel rails 425. Rails 425 each comprise a stop 430 at each end, for example, without limitation, rubber washers, to limit the travel of foot pads 401 on rails 425. Rails 425 may be attached to frame sections 405 by various different attachment means including, without limitation, screws, bolts, welding, adhesive, etc. Rails may or may not comprise end caps made of pliant materials such as, but not limited to, rubber or plastic.

In the present embodiment, exercise device comprises two foot pads 401 with one foot pad 401 resting on rails 425 of each frame section 405. Foot pads 401 are interchangeable between frame sections 405. Referring to FIGS. 4C through 4E, a base 435 on each foot pad 401 is designed for easy rail assembly. Each base 435 comprises two grooves, a bottom groove 440 and a side groove 445. Foot pads 401 are separate from frame sections 405 and rails 425. Referring to FIGS. 4D and 4E, bases 435 of foot pads 401 have a design that generally allows for ease of installation onto rails 425 by placing one rail 425 inside side groove 445 then tilting base 135 towards the second rail 425 so that the second rail 425 fits into bottom groove 440 of foot pad base 435. Referring to FIG. 4E, side groove 445 in base 435 curves under rail 425 when foot pad 401 is tilted into the final position upon the second rail 425. Side groove 445 helps to hold foot pad 401 in place during use. In the present embodiment, foot pads 401 freely glide forward and back along rails 425 of each frame section 405. The glide speed and resistance of the foot pads upon the rails is often individual to each user. Typically, no lubricant is required for foot pads 401 to slide along rails 425, and this sliding is generally even and quiet. Foot pads 401 comprise a cushioned top section 450, which may be made from a vast array of materials with various different textures and designs. The ease of installation of foot pads 401 typically enables foot pads 401 to be interchangeable to provide various different foot pad patterns, textures, shapes, styles, colors, features, accessories, etc. For example, without limitation, foot pads can be made with straps to hold the foot, with foot toe cups for therapy users, with various different foot contours, with company logos, with tie on covers that can be changed for each user. Replacement pads may be made available if the original foot pads wear out or if multiple users are using the device. In the present embodiment, padded foot pads 401 work well with rubber soled shoes, low heeled work shoes, flat shoes, or bare feet.

Referring to FIGS. 4A and 4B, frame sections 405 comprise stainless steel tubing bent with two 90 degree angles to form a C shape. When assembled, exercise device makes a generally rectangular shape. In the present embodiment, each frame section 401 measures approximately 10.5 inches wide by 23 inches long to create a total assembled width of 21 inches. Those skilled in the art will readily recognize, in light of and in accordance with the teachings of the present invention, that exercise devices in some alternate embodiments may be made from a multiplicity of suitable materials in various different shapes and sizes. In the present embodiment, each frame section 401 is independently stable and functional. When connected at pivot point 420, frame sections 401 form exercise device 400 as a whole. Pivot point 420 enables frame sections 401 to be splayed open for range of motion function. In typical use of the present embodiment, a user opens frame sections 401 to the angle needed to form the foot movement pattern of choice. Once frame sections 401 are in the desired splay angle, the user places his feet upon foot pads 401 and slides foot pads 401 back and forth on rails 425 with his feet. The feet of the user do not have to be centered upon foot pads 401 for exercise device 400 to operate properly. The two rail system and the design of bases 435 typically work in conjunction with each other to allow for shifting of position and weight of the feet while generally maintaining a smooth back and forth gliding motion.

In the present embodiment, the simplicity of the design of the frame and rail systems of exercise device 400 may help to lower manufacturing costs and reduce required assembly during the manufacturing process. When disconnected, frame sections 401 can be stacked bottom to bottom to be boxed for shipment or storage, or bagged to carry while minimizing the space required. The frame and rail assemblies may be manufactured and shipped fully assembled or may be provided fully or partially unassembled to save manufacturing costs, time and space. Consumers are generally able to assemble exercise device 400 with one tool for installation of rails 425 upon frame sections 405 and simple minimal steps.

Those skilled in the art will readily recognize, in light of and in accordance with the teachings of the present invention, that the embodiments described in the foregoing may be used for upper body exercises. When using an exercise device according to many embodiments of the present invention for upper body exercises, a user typically places the device on a table top with the rear of the unit facing the seated user. Alternatively, the user may be standing. In addition, for some types of exercises, the user may have the open front portion of the unit facing him. If adjustable, the frame of the device is set to match the user's arm/shoulder width. The user may then use the device as an upper body exercise device by placing his hands in a flat position on the foot pads and moving the foot pads in a desired pattern. Various foot pad designs could utilize different user hand positions while exercising. For example, without limitation, a foot holding strap design for the foot pad top may be used as a hand hold or the foot pads may be modified with a vertical dowel type hand grip.

All the features disclosed in this specification, including any accompanying abstract and drawings, may be replaced by alternative features serving the same, equivalent or similar purpose, unless expressly stated otherwise. Thus, unless expressly stated otherwise, each feature disclosed is one example only of a generic series of equivalent or similar features.

Having fully described at least one embodiment of the present invention, other equivalent or alternative methods of providing an exercise device that may be used while seated according to the present invention will be apparent to those skilled in the art. The invention has been described above by way of illustration, and the specific embodiments disclosed are not intended to limit the invention to the particular forms disclosed. For example, the particular implementation of the device may vary depending upon the particular type of tracks used. The tracks described in the foregoing were directed to linear implementations; however, similar techniques are to incorporate tracks with different configurations such as, but not limited to, arcs, circles, etc. Non-linear implementations of the present invention are contemplated as within the scope of the present invention. The invention is thus to cover all modifications, equivalents, and alternatives falling within the spirit and scope of the following claims.

Claim elements and steps herein have been numbered and/or lettered solely as an aid in readability and understanding. As such, the numbering and lettering in itself is not intended to and should not be taken to indicate the ordering of elements and/or steps in the claims.

What is claimed is:

1. An apparatus for aerobic leg exercise of a seated user, the apparatus consisting of:

a first unit comprising:

a first frame comprising a first bar, said first unit further comprises first and second extending arms at each distal end of said first bar;

a first track into engagement with and disposed substantially between said extending arms; and a first foot pad unit slidably into mechanical engagement with said first track, said first foot pad unit comprising a base portion having at least one groove being configured into engagement with said first track and a cushioned top portion being configured for substantially moving said first foot pad unit along said first track; and a second unit comprising:

a second frame comprising a second bar, said second unit further comprises first and second extending arms at each distal end of said second bar;

a second track being configured into engagement with and disposed between said extending arms; and a second foot pad unit slidably into mechanical engagement with said second track, said second foot pad unit comprising a base portion having at least one groove being configured into engagement with said second track and a cushioned top portion for substantially moving said second foot pad unit along said second track;

wherein said first arm of said first frame and said first arm of said second frame are engaged via a single pivot and said second arms of said first and second frames are not engaged with one another; and means for securing said first unit and said second unit, said securing means comprises said pivot, said pivot configured to be operable for adjusting a splay angle between said first unit and said second unit, wherein said splay angle being configured at different angles and said first unit and said second unit being operable to adjustably position at said different angles.

2. An apparatus for aerobic exercise, the apparatus comprising:

a first unit comprising:

a first frame comprising a c-shape having a first arm and a second arm;

a first track comprising at least two rods, said first track being disposed substantially between said first arm and said second arm; and a first pad unit slidably into mechanical engagement with said first track, said first pad unit comprising a base portion having at least two grooves being configured into engagement with said two rods, and a top portion to contact for substantially moving said first pad unit along said first track; and a second unit comprising:

a second frame comprising a c-shape having a first arm and a second arm; a second track comprising at least two rods, said second track being disposed substantially between said 1st arm and said 2nd arm; and a second pad unit slidably into engagement with said second track, said second pad unit comprising a base portion having at least two grooves being configured into engagement with said two rods, and a top portion to contact for substantially moving said second pad unit along said second track;

wherein said first arm of said first frame and said first arm of said second frame are engaged via a single pivot and said second arms of said first and second frames are not engaged with one another; and means for securing said first unit and said second unit, said securing means comprises said pivot, said pivot being configured to adjust a generally splay angle between said first unit and said second unit.

3. The apparatus as recited in claim 2, in which a first of said at least two grooves is disposed on a proximate side of said base portion and a second of said at least two grooves is disposed on a proximate bottom of said base portion.

4. The apparatus as recited in claim 2, in which said first pad unit and said second pad unit are substantially interchangeable.

5. The apparatus as recited in claim 2, wherein said splay angle is substantially adjustable from a generally narrow angle to a generally wide angle.

6. The apparatus as recited in claim 2, further comprising at least two or more traction means being into engagement with at least a surface of said first frame and said second frame for contacting a work surface to substantially provide stability of said apparatus during use.

7. The apparatus as recited in claim 2, further comprising two or more stops being configured into engagement with proximate ends of said rods for substantially limiting travel of said first pad unit and said second pad unit.

8. The apparatus as recited in claim 2, further comprising end caps being configured into engagement with proximate ends of said top arms.

* * * * *